US011168938B2

(12) United States Patent
Willis

(10) Patent No.: US 11,168,938 B2
(45) Date of Patent: Nov. 9, 2021

(54) DUAL USE USER INTERFACE AND DOOR POSITION SENSORS

(71) Applicant: Electrolux Home Products, Inc., Charlotte, NC (US)

(72) Inventor: Timothy Willis, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/666,784

(22) Filed: Oct. 29, 2019

(65) Prior Publication Data

US 2020/0064059 A1 Feb. 27, 2020

Related U.S. Application Data

(63) Continuation of application No. 14/194,005, filed on Feb. 28, 2014, now Pat. No. 10,473,389.

(51) Int. Cl.

| | |
|---|---|
| ***F25D 29/00*** | (2006.01) |
| ***F25D 23/02*** | (2006.01) |
| ***F25B 49/02*** | (2006.01) |

(52) U.S. Cl.

CPC ..... *F25D 29/005* (2013.01); *F25B 49/02* (2013.01); *F25D 23/028* (2013.01); *F25D 2400/361* (2013.01); *F25D 2700/02* (2013.01); *F25D 2700/12* (2013.01)

(58) Field of Classification Search

CPC ..... F25D 2400/361; F25D 2700/02; F25D 29/005; F25D 23/028; F25D 2700/12; F25B 49/02; D06F 34/28

See application file for complete search history.

(56) References Cited

U.S. PATENT DOCUMENTS

| | | | | |
|---|---|---|---|---|
| 4,966,004 | A * | 10/1990 | Midlang | F25D 29/005 200/302.2 |
| 8,011,203 | B1 | 9/2011 | Schenk et al. | |
| 8,049,518 | B2 | 11/2011 | Wern et al. | |
| 8,245,735 | B2 | 8/2012 | Chase et al. | |
| 8,248,086 | B2 | 8/2012 | Cooper et al. | |
| 8,981,698 | B2 * | 3/2015 | Fuhge | E05F 15/79 318/484 |
| 9,085,453 | B2 | 7/2015 | McMahan | |

(Continued)

FOREIGN PATENT DOCUMENTS

| | | | |
|---|---|---|---|
| AU | 2009200531 | 9/2009 | |
| AU | 2009200531 A1 * | 9/2009 | F25D 29/00 |

OTHER PUBLICATIONS

International Search Report and Written Opinion for PCT/US2015/015197 dated May 8, 2015.

*Primary Examiner* — Frantz F Jules
*Assistant Examiner* — Martha Tadesse
(74) *Attorney, Agent, or Firm* — Pearne & Gordon LLP

(57) ABSTRACT

A refrigeration appliance including both a user interface and door position sensor. The same devices and sensors are for both functions. The user interface is mounted on a door or mullion in such a way that all or nearly all of the input devices on the user interface are activated simultaneously or nearly simultaneously when a door is closed so that the user interface can distinguish this action from user inputs in which only one or two input devices are activated at a time. Likewise, when all input devices are inactivated nearly simultaneously, the user interface may know that a door has been opened.

8 Claims, 5 Drawing Sheets

(56) References Cited

U.S. PATENT DOCUMENTS

| | | | | |
|---|---|---|---|---|
| 2007/0159454 | A1* | 7/2007 | Rodriguez | A47L 15/4293 345/156 |
| 2008/0006042 | A1* | 1/2008 | Lee | F25D 29/00 62/163 |
| 2009/0072884 | A1 | 3/2009 | Uhov et al. | |
| 2009/0284157 | A1* | 11/2009 | Wetekamp | F25D 27/005 315/154 |
| 2011/0209493 | A1* | 9/2011 | Schenk | F25D 23/028 62/389 |
| 2012/0073321 | A1 | 3/2012 | Davis et al. | |
| 2013/0002445 | A1 | 1/2013 | Stibich | |

* cited by examiner

DUAL USE USER INTERFACE AND DOOR POSITION SENSORS

CROSS-REFERENCE TO RELATED APPLICATIONS

This application is a continuation of U.S. patent application Ser. No. 14/194,005 filed on Feb. 28, 2014. This application is hereby incorporated herein by reference.

BACKGROUND OF THE INVENTION

1. Field of the Invention

The present invention is related generally to a refrigeration appliance, and, more particularly, to a refrigeration appliance including a dual user interface and door position sensor.

2. Description of Related Art

Traditionally, refrigeration appliances, including freezers, have detected whether the door(s) of the appliance were open or closed. Many refrigeration appliances now also contain a user interface for setting user preferences. Presently, however, both the user interface and door position sensor use independent sensors and circuitry.

BRIEF SUMMARY OF THE INVENTION

The following summary is meant only to provide a basic overview of the present invention and is therefore not meant to be limiting in any way. In light of the above, there is presently a need for a refrigeration appliance that combines the sensors of the user interface and the door positioning system into a single system. In general, the present invention utilizes touch sensitive sensors as input devices for controls of a user interface and to additionally detect whether a door of the refrigeration appliance is open. This is accomplished by recognizing that the activation or inactivation of nearly all of the sensors of the user interface can indicate a changing door state whereas the activation or inactivation of only a few sensors indicates user interaction with the user interface.

According to one example of the present invention, a refrigeration appliance can comprise at least one door; at least one surface, the at least one surface being a surface of the at least one door or a mullion of the refrigeration appliance; a user interface located on the at least one surface and comprising at least two sensors, each sensor adapted for communicating a signal; and a controller, wherein the controller is capable of determining the state of the at least one door based at least in part on the signals of the at least two sensors of the user interface and controlling user interface interaction based at least in part on the signals of the at least two sensors of the user interface.

According to other examples of the above refrigeration appliance, at least one of the at least two sensors of the user interface is a capacitive sensor or an infrared proximity sensor; the refrigeration appliance further comprises a second door, wherein the at least one surface of the at least one door and a surface of the second door each comprise a substantially-planar side portion that oppose each other when the at least one door and the second door are in a closed state; the user interface is located on the substantially-planar side portion of the at least one door, such that all or nearly all of the at least two sensors are activated or inactivated nearly simultaneously when either the at least one door or the second door is in a closed state or opened state; the controller determines the state of the at least one door based at least in part on the near simultaneous activation or inactivation of all or nearly all of the at least two sensors of the user interface; the controller controls user interface interaction based at least in part on the near simultaneous activation or inactivation of only less than half of the at least two sensors of the user interface; and the user interface comprises at least two buttons, each of the at least two buttons comprising at least one of the at least two sensors, wherein the controller determines the state of the at least two buttons based at least in part on the near simultaneous activation of all or nearly all of the at least one of the at least two sensors comprised by each of the at least two buttons, and the controller determines the state of the at least one door based at least in part on the state of the at least two buttons.

According to another example, a refrigeration appliance comprises at least one door; at least one surface, wherein the at least one surface is in closer proximity to the at least one door when the at least one door is in a closed state, than when the at least one door is in an opened state; a user interface comprising at least two sensors, each of the at least two sensors adapted for communicating a signal, wherein the user interface is located on either the at least one door or the at least one surface; and a controller electrically connected to the user interface and the at least two sensors, wherein the controller determines the state of the at least one door based on the signals of the at least two sensors.

According to other examples of the above refrigeration appliance, at least one of the at least two sensors of the user interface is a capacitive sensor or an infrared proximity sensor; the at least one surface is a surface of a second door; the controller determines the state of the at least one door based at least in part on the near simultaneous activation or inactivation of all or nearly all of the at least two sensors of the user interface; the controller controls user interface interaction based at least in part on the near simultaneous activation or inactivation of only less than half of the at least two sensors of the user interface; and the user interface comprises at least two buttons, each of the at least two buttons comprising at least one of the at least two sensors, wherein the controller determines the state of the at least two buttons based at least in part on the near simultaneous activation of all or nearly all of the at least one of the at least two sensors comprised by each of the at least two buttons, and the controller determines the state of the at least one door based at least in part on the state of the at least two buttons.

In still another example, a refrigeration appliance comprises at least one door; at least one surface, wherein the at least one surface is in closer proximity to the at least one door when the at least one door is in a closed state, than when the at least one door is in an opened state; a user interface located at an interface of the at least one door and the at least one surface; a controller; and a sensor system, the sensor system further comprising at least two sensors attached to the user interface, adapted for communicating a signal to the controller, and being located at the interface of the at least one door and the at least one surface, wherein the controller is capable of determining the state of the at least one door based at least in part on the activation or inactivation of the at least two sensors of the of the sensor system and the controller is further capable of controlling the user interface based at least in part on the activation or inactivation of the at least two sensors of the of the sensor system.

According to other examples of the above refrigeration appliance, at least one of the at least two sensors of the user interface is a capacitive sensor or an infrared proximity sensor; the controller determines the state of the at least one door based at least in part on the near simultaneous activation or inactivation of all or nearly all of the at least two sensors of the user interface; the controller controls user interface interaction based at least in part on the near simultaneous activation or inactivation of only less than half of the at least two sensors of the user interface; and the user interface comprises at least two buttons, each of the at least two buttons comprising at least one of the at least two sensors, wherein the controller determines the state of the at least two buttons based at least in part on the near simultaneous activation of all or nearly all of the at least one of the at least two sensors comprised by each of the at least two buttons, and the controller determines the state of the at least one door based at least in part on the state of the at least two buttons.

DETAILED DESCRIPTION OF THE INVENTION

The present invention pertains to a refrigeration appliance capable of utilizing a single sensor system for both a touch sensitive user interface and detecting the state of a door attached to the appliance.

Figure 1A:
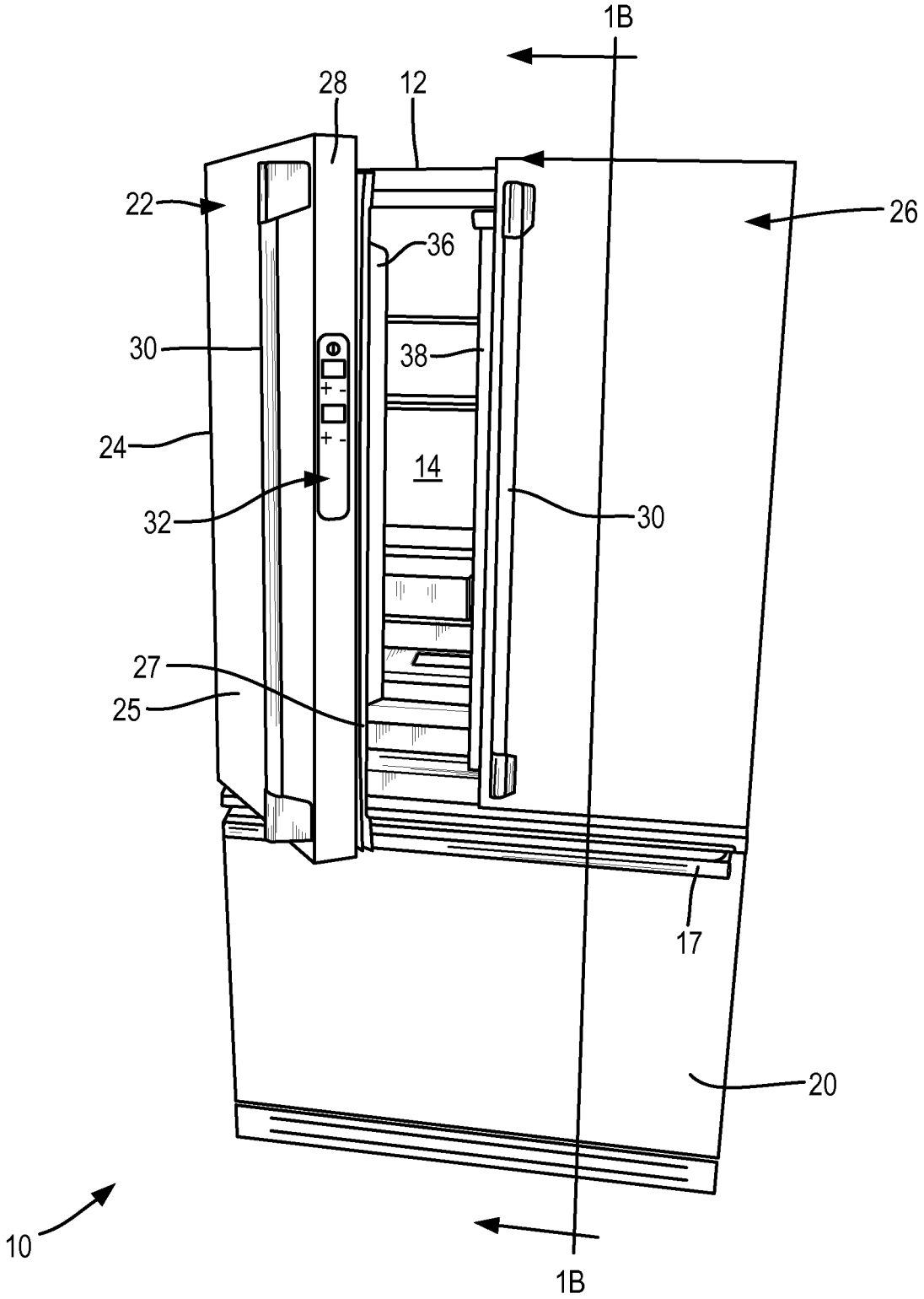
FIG. 1A illustrates a front view of an illustrative embodiment of a refrigeration appliance comprising a user interface on a substantially planar-side portion of a door.

FIG. 1A shows an illustrative embodiment of a refrigeration appliance 10. As shown the refrigeration appliance 10 includes a cabinet 12 defining a fresh-food compartment 14 for storing food items in a temperature-controlled environment having a fresh-food target temperature above 0° C. With reference to FIG. 1A and now also to FIG. 1B, the cabinet 12 also defines a freezer compartment 16 disposed at an elevation vertically beneath the fresh-food compartment 14 for storing food items in a temperature-controlled environment having a freezer target temperature that is less than 0° C. An automatic ice maker 15 can also optionally be disposed within the fresh-food compartment 14, and the ice formed by the ice maker 15 optionally exposed to the temperature within the fresh-food compartment 14. The temperatures and ranges provided are merely exemplary, and it is to be understood that other temperatures and ranges, including sub-ranges are also possible.

Figure 1B:
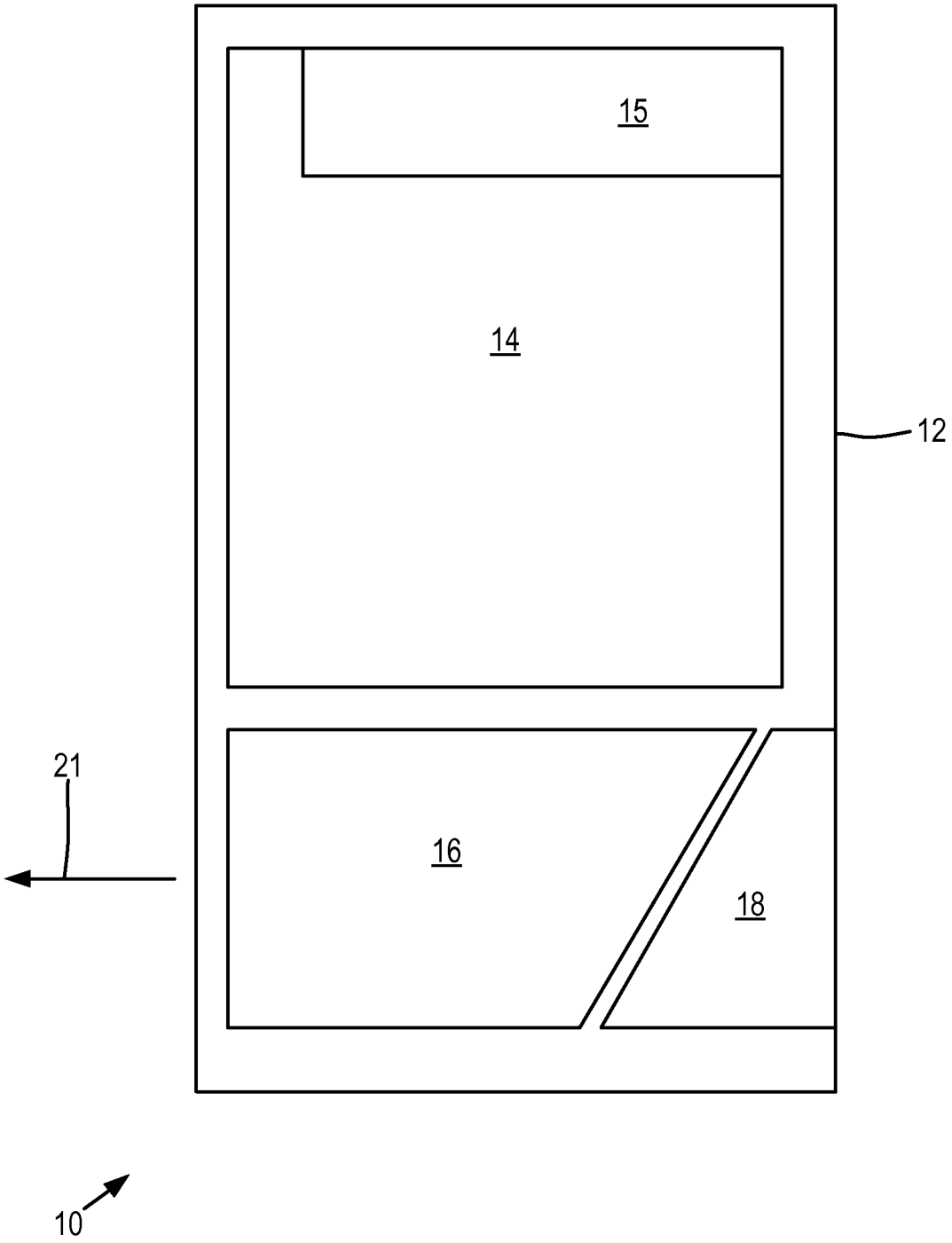
FIG. 1B illustrates a schematic sectional view taken along line 1B-1B shown in FIG. 1A.

The refrigeration appliance also includes a refrigeration system 18 shown schematically in FIG. 1B. The refrigeration system 18 is operable to provide a cooling effect to an interior of at least one of the fresh-food and freezer compartments 14, 16. The refrigeration system 18 can be any suitable cooling system employing a refrigerant that undergoes a phase change from liquid to gas in an evaporator as is known in the art to remove heat from air being introduced into at least one of the fresh-food and freezer compartments 14, 16. Generally, a compressor can be provided to the refrigeration system 18 to compress gaseous refrigerant to a high-temperature, high-pressure gas that is condensed and partially cooled to a warm liquid by a condenser. The warm liquid refrigerant is exposed to an interior of an evaporator assembly comprising many heat-transferring fins, in which the refrigerant rapidly expands and vaporizes into a gas. The phase change extracts the latent heat of vaporization from the ambient environment of the evaporator, thereby cooling air blown over the evaporator to be introduced into at least one of the fresh food and freezer compartments 14, 16 to provide the desired cooling effect. The gaseous refrigerant is returned to the compressor and the cycle repeated as necessary.

With continued reference to FIGS. 1A and 1B, a freezer drawer 20 is slidably supported within the freezer compartment 16 to store food items to be exposed to the sub-freezing temperatures and frozen within the freezer compartment 16. The freezer drawer 20 can be slidably extracted in the direction of arrow 21 (FIG. 1B) from the freezer compartment 16 to grant a user access to the contents stored therein. A substantially horizontal handle 17 extending across an exterior surface of a door provided to the freezer drawer 20 provides a surface that can be grasped to pull the freezer drawer 20 outwardly from within the freezer compartment 16.

To restrict access to a portion of the fresh food compartment 14, a first door 22 is pivotally connected adjacent to a first lateral side 24 to the cabinet 12. Likewise, a second door 26 is pivotally connected adjacent to a second lateral side 28 to the cabinet 12 with a hinge assembly to restrict access to another portion of the fresh-food compartment 14. The first and second doors 22, 26 are each insulated to minimize the escape of heat from the fresh food compartment 14, and thus, have a depth dimension that includes substantially-planar side portions 28 extending at least a part of the way between an exterior face 25 exposed to an ambient environment of the refrigeration appliance 10 and an interior portion 27 that is exposed to an interior of the fresh food compartment 14 while the doors 22, 26 are closed. The substantially-planar side portions 28 generally oppose each other when the first and second doors 22, 26 are in their closed positions. Planar faces of the side portions 28 can be substantially parallel to each other when the doors 22, 26 are in their closed positions. A handle 30 can be provided to each of the doors 22, 26, providing users with a surface to grasp when attempting to open the doors 22, 26.

To minimize the leakage of cool air from the fresh food compartment 14 between the doors 22, 26, cooperating mullion seal portions 36, 38 can optionally be provided to the first and second doors 22, 26 adjacent to the side portions 28. At least one of the mullion seal portions 36, 38 can be pivotally connected to the respective door 22, 26 to enable either of the doors 22, 26 to be closed before the other of the doors 22, 26. The other of the mullion seal portions 36, 38 can be a rubberized gasket that can contact the pivotally-connected of the mullion seal portions 36, 38 to form a seal. Thus, when the doors 22, 26 are closed the pivotal one of the mullion seal portions 36, 38 is rotated to expose a generally-planar surface to an exterior of the refrigeration appliance 10. The rubberized gasket mates with the substantially-planar surface to form a substantially airtight seal between the first and second doors 22, 26.

Figure 2:
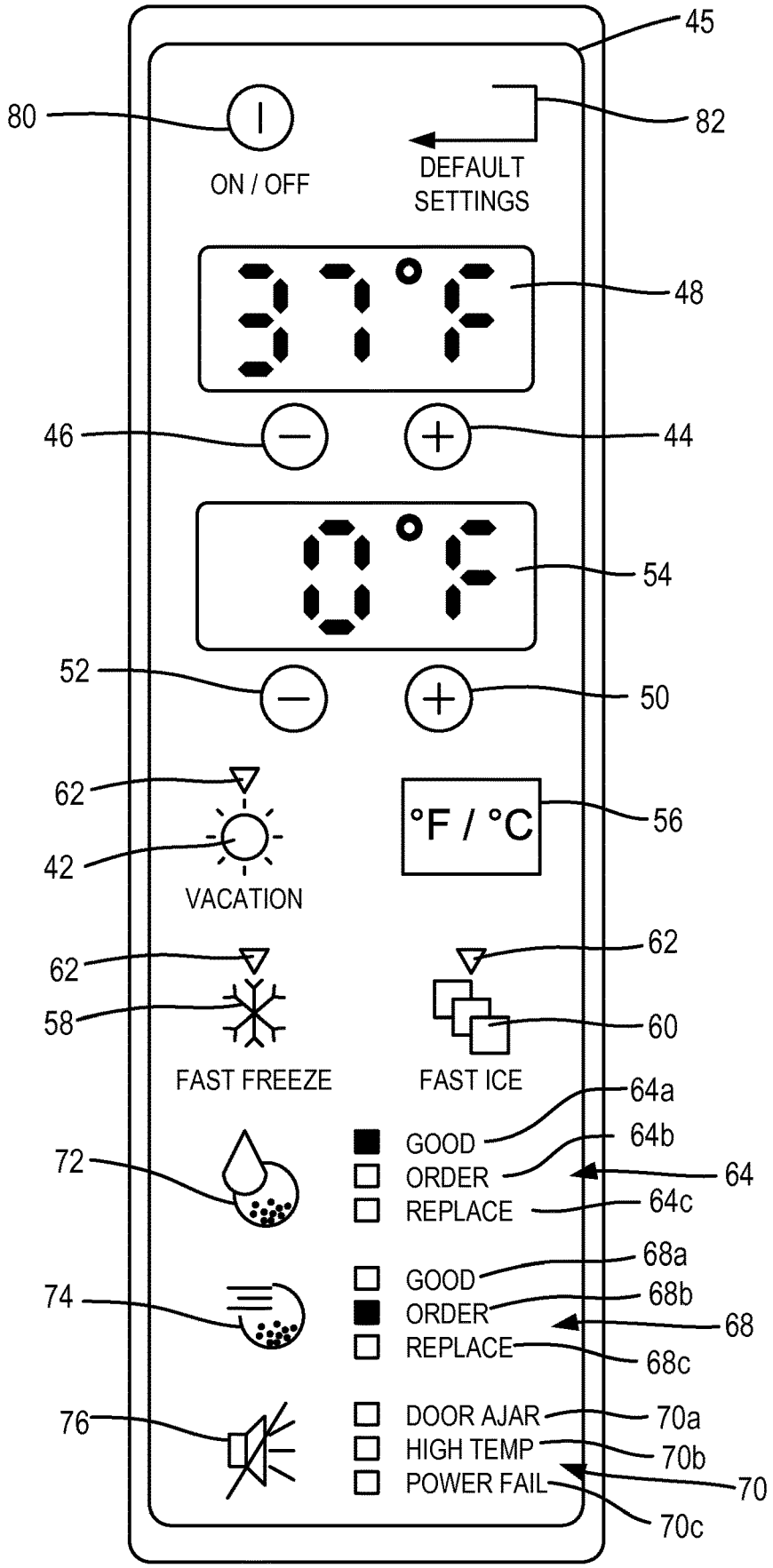
FIG. 2 illustrates the user interface of one embodiment of the present invention.

An example of a user interface 32 is illustrated in FIG. 2. The user interface 32 shown in FIG. 2 includes a plurality of touch sensitive sensors, such as capacitive touch sensors, infrared proximity sensors, or the like, that serve as input devices for interfacing with a variety of controls and displays on the user interface. These input devices, controls, and displays can be controlled by a controller, such as a microprocessor. The controller can interpret the signals of at least the input devices to determine the activity of each control and display, as well as door position as described in further detail below. Furthermore, the controller may also interact with sensors located throughout the refrigeration appliance as needed for the various displays and controls described in further detail below.

Each control or display may have one or more touch sensitive sensor associated with it. In these cases, a control is considered pressed when a predetermined number of sensors are activated, thereby establishing a level of sensitivity. In some embodiments, the activation of only one input device associated with the control may be required; however, in other embodiments, the activation of every input device associated with the control may be required. Some embodiments may also include a decorative overlay 45 that covers the user interface for identifying the function of the various controls and displays provided. However, alternate embodiments can include other forms of input devices that can be manipulated by a user to input a selection to the refrigeration appliance 10 via the user interface 32. For example, other embodiments of the user interface 32 can include push buttons, OLED or other type of display; tactile buttons; multi-position switches; knobs; or any other input device that is operable to input a user selection to a controller instead of, or in addition to the touch sensitive sensors. However, for the sake of brevity and simplicity the user interface 32 will be described herein as utilizing a single touch sensitive sensor as the input device for each control or display on the user interface 32.

The user interface 32 includes at least one control to be manipulated by a user for controlling a set temperature within at least one of the fresh-food and freezer compartments 14, 16. For the illustrative embodiment shown in FIG. 2, an "up" control 44 is provided to be pressed by the user for increasing the set temperature for the fresh food compartment 14 in one degree increments. Alternate embodiments allow for adjustment of target temperature in any desired increments, both smaller and larger than one degree. A "down" control 46 is also provided and can be pressed by the user for decreasing the set temperature for the fresh food compartment 14 in one degree increments for the present embodiment. The current target temperature for the fresh food compartment 14 can be displayed by a seven-segment display 48 or any other suitable display device provided adjacent to the up and down controls 44, 46 for controlling the displayed temperature. Instead of the current target temperature, embodiments of the seven-segment display 48 can optionally display a sensed temperature within the fresh food compartment 14. Alternate embodiments of the seven-segment display 48 can optionally display a sensed temperature within the fresh food compartment 14 until a user pushes one of the up or down controls 44, 46 to adjust the target temperature for the fresh food compartment 14, at which time the seven-segment display 48 can temporarily display the current target temperature for the fresh food compartment 14 before reverting back to the sensed temperature.

The embodiment illustrated in FIG. 2 also has a similar arrangement for the freezer compartment 16. An "up" control 50 is provided and can be pressed by the user for increasing the set temperature for the freezer compartment 16. A "down" control 52 is also provided and can be pressed by the user for decreasing the set temperature for the freezer compartment 16. The current set temperature for the freezer compartment 16 can also be displayed by a seven-segment display 54 or any other suitable display device provided adjacent to the up and down controls 50, 52 for controlling the displayed temperature. Again, other embodiments of the user interface 32 can include display devices such as a LCD display, OLED display, or any suitable display other than the seven-segment displays 48, 54 shown in the illustrated example. And similar to the seven-segment display 48 discussed above, instead of the current target temperature, embodiments of the seven-segment display 54 can optionally display a sensed temperature within the freezer compartment 16. Alternate embodiments of the seven-segment display 54 can optionally display a sensed temperature within the freezer compartment 16 until a user pushes one of the up or down controls 50, 52 to adjust the target temperature for the freezer compartment 16, at which time the seven-segment display 54 can temporarily display the current target temperature for the freezer compartment 16 before reverting back to the sensed temperature.

In addition to the controls 44, 46, 50, 52 for controlling the set temperature of at least one of the fresh food and freezer compartments 14, 16, other controls can also be provided to select an operational mode of the refrigeration appliance 10. For example, the vacation control 42 can be pushed by the user to initiate a vacation mode of the refrigeration appliance 10. Occasionally, the evaporator of the refrigeration system 18 described above will accumulate frost and will require defrosting to ensure that the evaporator can provide an efficient cooling effect. However, much of the frost that accumulates on the evaporator is the result of moisture introduced into the interior of the refrigeration appliance 10 when one or both of the doors 22, 26 and the freezer drawer 20 are opened. When the user is on vacation, these doors 22, 26 and the freezer drawer 20 will ostensibly not be opened in the user's absence. Thus, initiating the vacation mode by pressing the vacation control 42 sets the time between scheduled defrost cycles to its maximum value, thereby minimizing the number of energy-consuming defrost cycles that are performed, possibly unnecessarily.

A "units" control 56 can be pressed by the user to specify the units of measurement to be used for displaying the set temperature for the fresh food compartment 14, freezer compartment 16 or both. Each pressing of the units control 56 toggles the units of measurement between Fahrenheit and Celsius.

The illustrative user interface 32 shown in FIG. 2 also includes a "fast freeze" control 58 that can be selected to put the refrigeration appliance 10 in "fast freeze" mode. In fast freeze mode the set temperature within the freezer compartment 16, or a portion thereof, is lowered, possibly drastically lowered, to a predetermined set temperature pre-programmed into a controller of the refrigeration appliance. With the set temperature lowered, the refrigeration system 18 is activated in an attempt to quickly lower the actual temperature in the freezer compartment 16 (or portion thereof) to meet the pre-programmed set temperature. Thus, food items introduced to the freezer compartment 16 and subjected to the fast freeze mode can be quickly frozen in an attempt to preserve the fresh taste of the food items when unfrozen.

A "fast ice" control 60 can be provided to the user interface 32 to enable a user to initiate a "fast ice" mode. In the fast ice mode the automatic ice maker 15 provided to the refrigeration appliance 10 is operated in a manner that produces ice at a faster rate than when the fast ice mode is not active. For example, the ice maker operating in the fast ice mode can produce about 50% more ice than it produces when not in the fast ice mode.

One or more, or in the case of the illustrative embodiment shown in FIG. 2, all of the various mode controls can be accompanied by an indicator 62 that signals to the user that one or more of the available operating modes of the refrigeration appliance 10 is active. The indicators 62 can be a window in the decorative overlay 45 that can be illuminated by a LED or other illumination device within the user interface 32. Any form of indicator 62 other than a LED-illuminated window that can convey the operational mode(s) of the refrigeration appliance 10 can be used in addition to, or in lieu of the LED illuminated window in the decorative overlay 45.

The user interface 32 in FIG. 2 also includes another status indicator indicating a status of at least one consumable product used by the refrigeration appliance 10. For the illustrative example shown, a water filter indicator 64 provides a user with an indication of whether a water filter of the refrigeration appliance 10 is ready to be replaced. The water filter can be provided to the refrigeration appliance 10 to minimize impurities in fresh water to be dispensed through a water dispenser provided to the refrigeration appliance 10, to minimize impurities in fresh water to be delivered to the automatic ice maker 15, or to minimize the impurities in fresh water used in any other manner by the refrigeration appliance. The water filter indicator 64 can include a "GOOD" status 64*a* that, if illuminated or otherwise active, signifies that the water filter is not near the end of its useful life. An "ORDER" status 64*b*, if illuminated or otherwise active, alerts the user when it is time to order a new water filter. The ORDER status 64*b* can forewarn the user of the upcoming need for a new water filter before the water filter has actually reached the end of its useful life and is to be replaced. The user can acquire a new water filter and have it available when the time to replace the existing water filter comes to avoid an interruption in the availability of filtered water. And finally, a "REPLACE" status 64*c* indicates that the existing water filter has reached the end of its useful life and should immediately be replaced. The statuses 64*a-c* can be based on a timer, reminding the user to change the water filter, for example, once at the end of a predetermined period of time. According to alternate embodiments, the statuses 64*a-c* can be based on a factor other than time.

Similar to water filter indicator 64, an air filter indicator 68 can be provided to the user interface 32 instead of, or in addition to the water filter indicator 64. An air filter can be disposed within the fresh-food compartment 14, freezer compartment 16, or both to minimize foul odors from food within the refrigeration appliance 10. The air filter indicator 68 shown in FIG. 2 also includes three different statuses 68*a-c* indicating whether the air filter provided to the refrigeration appliance 10 is in a "GOOD" condition, is nearing time for replacement or is at the end of its useful life. In FIG. 2, the water filter indicator 64 indicates that the status of the water filter is GOOD 64*a* and the air filter indicator 68 indicates that the status of the air filter is ORDER 68*b*.

The user interface 32 can optionally include a system status indicator 70 to inform the user of an operational state of the refrigeration appliance 10 and/or the refrigeration system 18. For instance, the embodiment of the system status indicator 70 shown in FIG. 2 informs the user whether the audible alert signals broadcast by the refrigeration appliance 10 in response to one or more sensed conditions are active. A door ajar indicator 70*a* can be illuminated to indicate that the door ajar alert signal is muted. In this condition the audible alert that would ordinarily sound in response to one or both of the doors 22, 26 and/or the freezer drawer 20 remaining open for a predetermined period will not be sounded. Likewise, a high temperature indicator 70*b* can inform the user that a high-temperature alert that is ordinarily sounded when the temperature in either or both of the fresh-food compartment 14 and the freezer compartment 16 has exceeded a threshold warm temperature has been muted. And a power failure indicator 70*c* can alert the user that the power failure alert sounded when the refrigeration appliance 10 loses electric power is muted.

Each of the water filter indicator 64 and the air filter indicator 68 can be independently reset to their GOOD statuses 64*a*, 68*a* if the user presses and holds the water filter control 72 and the air filter control 74, respectively, for a predetermined period of time. Thus, when the water filter and the air filter are replaced with new filters, their respective statuses can be reset to start the timer that is to remind the user as the new filters approach the end of their useful lives.

Similarly, a mute control 76 is also provided to allow the user to toggle through the various audible alerts that can be muted. Each push of the mute control 76 changes the audible alert that is muted and toggles through various, optionally all, available combinations. For the embodiment shown in FIG. 2 none of the available audible alerts are muted.

A power control 80 and a reset control 82 are provided to allow the user the ability to control the operation of the refrigeration appliance 10 as a whole. Pressing and holding the power control 80 for a predetermined period of time deactivates the refrigeration appliance 10, thereby preventing the refrigeration system 18 from providing the cooling effects described herein. Likewise, pressing and holding the reset control 82 for a predetermined period of time restores all settings of the refrigeration appliance such as the target temperature of the fresh-food compartment 14 and the freezer compartment 16, for example, to their factory-established values.

The above description of the user interface 32 details one embodiment of its user interaction functions. However, the present invention also utilizes the user interface 32 as a door positioning sensor. A door positioning sensor, as used in this description, refers to a device that is capable of determining the open/closed state of a door of a refrigeration appliance. In some embodiments, the door positioning sensor will not only be able to tell that a door is open or closed, but will be able to tell which door is open or closed, and accordingly, which refrigeration compartment is associated with that door. Where the user interface 32 primarily interacts with the user by the pressing of a single, or just a few, input devices in order to activate a control, the user interface 32 acts as a door positioning sensor when all, or nearly all of the input devices are activated or inactivated simultaneously or nearly simultaneously. By nearly all of the input devices, it is preferably meant that at least half of the input devices are activated or inactivated; more preferably, it is meant that at least three-quarters of the input devices are activated or inactivated; even more preferably, it is meant that at least ninety percent of the input devices are activated or inactivated; still more preferably, it is meant that all but one of the input devices are activated or inactivated. By nearly simultaneous, it is preferably meant that the input devices are activated or inactivated within a second of each other; more preferably, it is meant that the input devices are activated or inactivated within a tenth of second of each other; even more preferably, meant that the input devices are activated or inactivated within a ten milliseconds of each other; still more preferably, meant that the input devices are activated or inactivated within a millisecond of each other.

Figure 3:
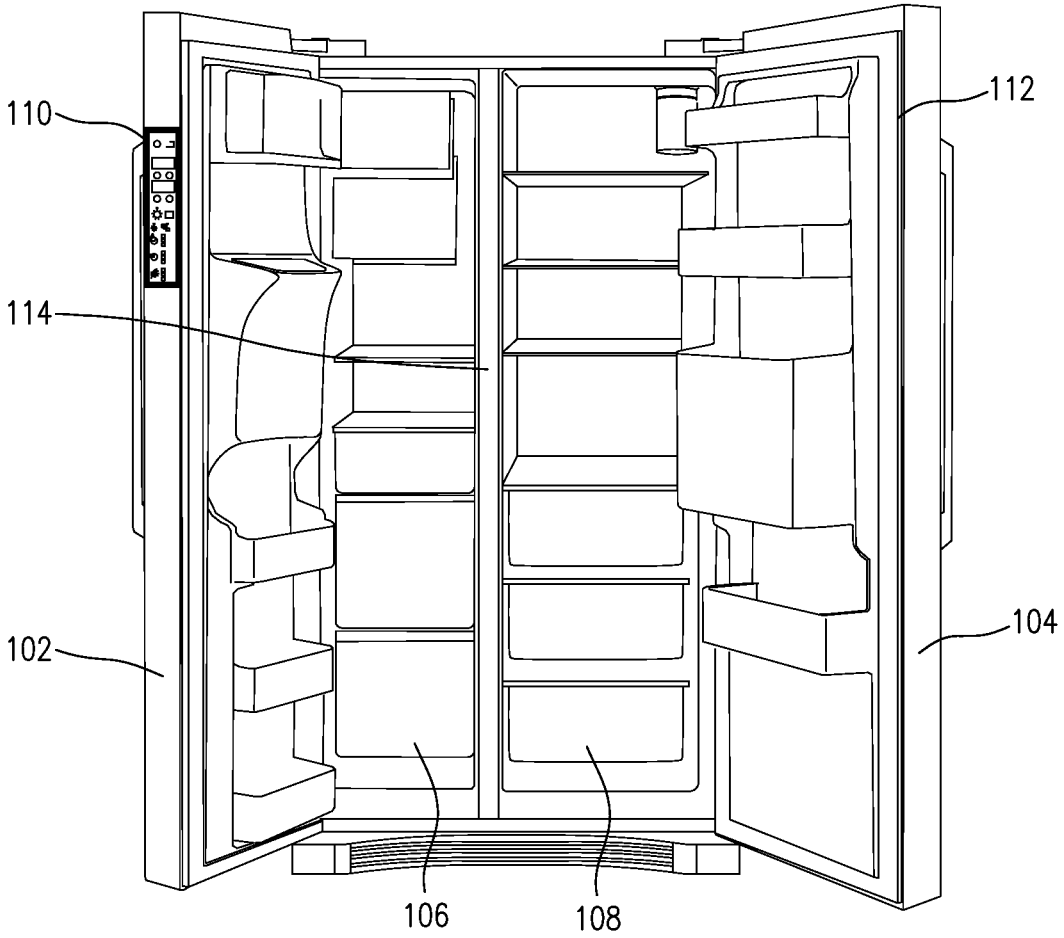
FIG. 3 illustrates one embodiment of the present invention on a side-by-side refrigeration appliance.

As detailed in the remaining figures, the user interface 32 may be located in a variety of locations on the refrigeration appliance in order to act as a door positioning sensor, so long as the state of the input devices of the user interface 32 can be modified by a door's changing state. Upon the happening of such an event, the door ajar indicator 70*a* can be illuminated or the door alert signal can be sounded. FIG. 3 illustrates one embodiment of the present invention as used for a "side-by-side" refrigeration appliance. In a side-by-side configuration, a first door 102 is pivotally connected adjacent to a first lateral side of the cabinet of the refrigeration appliance; and, a second door 104 is pivotally connected adjacent to a second lateral side of the cabinet of the refrigeration appliance, with a hinge assembly to restrict access to another portion of the fresh-food compartment 14. In most embodiments of a side-by-side refrigeration appliance, the first door 102 reveals a freezer compartment (a freezer door), while the second door 104 reveals a refrigeration compartment (a refrigerator door). However, some embodiments may be solely refrigerators or freezers, or the freezer and refrigeration compartments may be flipped.

In the embodiment shown in FIG. 3, a user interface 110, similar to user interface 32 described above in reference to FIG. 2, is located on the substantially-planar side portion of the freezer door 102. In other embodiments, the user interface 110 may be similarly located on the refrigerator door at the location identified by character reference 112. Given this configuration, when both the freezer and refrigerator doors 102, 104 are closed, the user interface 110 faces the substantially-planar side portion of the opposing door. In many embodiments, this side of the door is close enough to the user interface 110 to active all or nearly all of the input devices of the user interface. The input devices can then also remain activated while both doors are closed. In some embodiments, such as those using tactile input devices, this may require that the two planar sides be in contact with each other; however, in other embodiments, such as those utilizing infrared proximity sensors, there may be a gap between the planar sides. The gap may be of any size, and will vary depending on the input device used, but is preferably less than two inches. Similarly, when either door 102, 104 is opened, all or nearly all of the input devices of the user interface 110 will become and remain inactivate while either door is open. In this way, the controller of the user interface 110 is unable to distinguish which compartment door has opened because both doors 102, 104 must be closed in order to activate all or nearly all of the input devices on the user interface 110; but either one, or both, of the doors 102, 104 must be open in order to inactivate all or nearly all of the input devices on the user interface 110.

Other embodiments, however, may place the user interface 110 on a surface of the mullion seal portion 114. Thus, when a door is closed and the rubberized gasket mates with the mullion seal portion 114 comprising the user interface 110, the mating can activate all or nearly all of the input devices of the user interface 110 simultaneously or nearly simultaneously as previously described. In this scenario, the controller of the user interface 110 may be able to determine which door has been opened or closed because the user interface 110 may be located on a part of the mullion 114 associated only one of the doors 102, 104.

Figure 4:
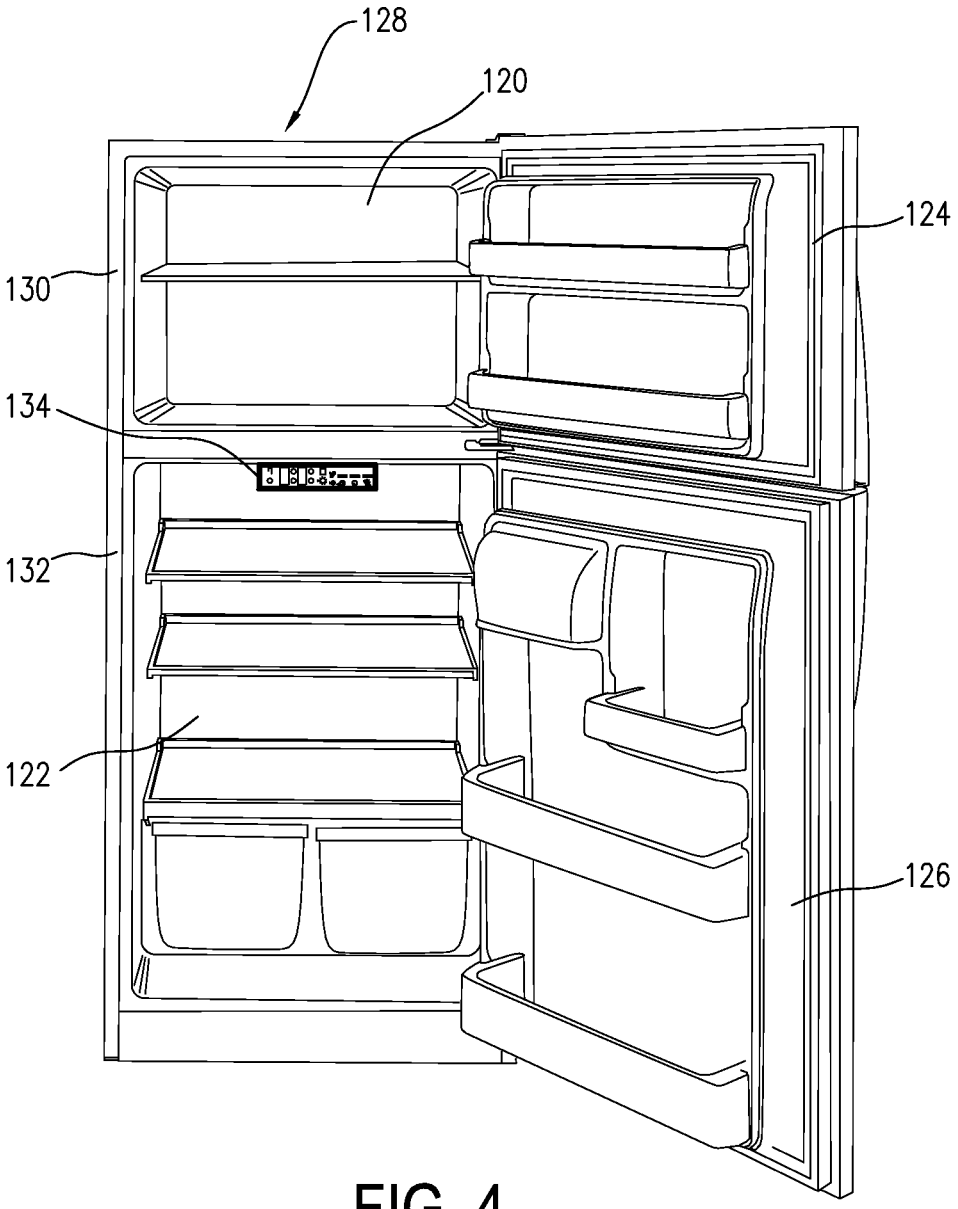
FIG. 4 illustrates one embodiment of the present invention on a top-mount refrigeration appliance.

FIG. 4 illustrates one embodiment of the present invention on a "top-mount" refrigeration appliance. In a top-mount configuration, a freezer compartment 120 is mounted on top of a refrigerator compartment 122, each having a separate door 124, 126. Both doors can be pivotally connected with a hinge assembly to the cabinet 128 and create a seal by mating a rubberized gasket to a mullion seal portion 130, 132 surrounding each compartment as previously described. In the embodiment of FIG. 4, a user interface 134 can be mounted on the refrigerator compartment 122 side of the refrigerator mullion area 132 between the freezer 120 and refrigerator 122 compartments. In such an embodiment, when the refrigerator door 126 is closed, the inside of the refrigerator door 126 can be close enough to input devices of the user interface 134 such that all or most of input devices are activated; however, when the refrigerator door 126 is open, all or most of the input devices can then become and remain inactivate. It should also be noted that a user interface may instead, or additionally, be mounted on the freezer mullion 130. In such embodiments, the freezer door 124 then acts to activate and inactivate the input devices of the user interface 134. Furthermore, a user interface may similarly be mounted to a mullion in a bottom mount refrigeration appliance. Still further, a French door bottom mount refrigeration appliance may contain any combination of touch sensitive user interfaces as described throughout this detailed description. In these scenarios, the controller of the user interface is capable of determining which compartment doors are open because the two surfaces (either door-mullion or door-door) involved in the activation or inactivation of all or most of input devices are associated with either a refrigeration or freezer compartment.

It is to be understood that the foregoing detailed description is not meant to be limiting in any way. Rather, it describes various preferred embodiments of the present invention.

What is claimed is:

1. A refrigeration appliance comprising:

a controller;

a first door and a second door, a substantially-planar portion of the first door opposing a substantially-planar portion of the second door when the first door and the second door are in a closed state;

a user interface located on the substantially-planar portion of the first door or the substantially-planar portion of the second door, the user interface comprising a sensor configured to transmit a signal to the controller, wherein the controller is configured to:

determine that the first door or the second door is in an opened state or in the closed state based at least in part on the signal from the sensor of the user interface, and detect a user input at the user interface based at least in part on the signal from the sensor of the user interface.

2. The refrigeration appliance of claim 1, wherein the sensor of the user interface is a capacitive sensor or an infrared proximity sensor.

3. The refrigeration appliance of claim 1, wherein:

the user interface comprises a plurality of sensors, and the plurality of sensors are activated or inactivated nearly simultaneously when the first door or the second door is changed between the closed state and the opened state.

4. The refrigeration appliance of claim 3, wherein the controller is configured to determine the state of the first door or the second door based at least in part on the near simultaneous activation or inactivation of the plurality of sensors of the user interface.

5. The refrigeration appliance of claim 3, wherein the controller is configured to detect the user input based at least in part on the near simultaneous activation or inactivation of only less than half of the plurality of sensors of the user interface.

6. The refrigeration appliance of claim 1, wherein:

the user interface comprises a first plurality of sensors corresponding to a first button, and a second plurality of sensors corresponding to a second button, and the controller is configured to:

determine a state of the first button or the second buttoned based at least in part on a near simultaneous activation of the sensors corresponding to the first button or the second button, and determine that the first door or the second door is in an opened state or in the closed state based at least in part on the determined state of the first button and the second button.

7. The refrigeration appliance of claim 6, wherein the controller is configured to:

determine that the first door and the second door are in a closed state when the first button and the second button are determined to be in an activation state, and determine that the first door or the second door is in an opened state when only one of, or neither of, the first button and the second button are determined to be in an activation state.

8. The refrigeration appliance of claim 1, wherein the first door is next to the second door, so that the substantially-planar portion the first door comprises a lateral wall of the first door and the substantially-planar portion of the second door comprises a lateral wall of the second door.

* * * * *